United States Patent [19]

Case

[11] 4,074,545

[45] Feb. 21, 1978

[54] BIMETAL LID LOCK

[75] Inventor: Richard P. Case, Webster City, Iowa

[73] Assignee: Franklin Manufacturing Company, St. Cloud, Minn.

[21] Appl. No.: 718,056

[22] Filed: Aug. 26, 1976

[51] Int. Cl.[2] ..... D06F 37/42

[52] U.S. Cl. ..... 68/12 R; 192/136; 210/146; 292/DIG. 69

[58] Field of Search ..... 68/12 R, 23 R, 139; 134/57 DL, 58 DL; 292/DIG. 69; 210/146, 149; 192/136

[56] References Cited

U.S. PATENT DOCUMENTS

| | | | |
|---|---|---|---|
| 2,618,282 | 11/1952 | Stanitz et al. | 292/DIG. 69 |
| 2,738,072 | 3/1956 | Knight | 68/12 R X |
| 2,896,641 | 7/1959 | Kauffman et al. | 292/DIG. 69 |
| 2,936,892 | 5/1960 | McNeil et al. | 210/146 |
| 3,408,834 | 11/1968 | McMillan | 68/12 R |

*Primary Examiner*—Philip R. Coe

*Attorney, Agent, or Firm*—McNenny, Pearne, Gordon, Gail, Dickinson & Schiller

[57] ABSTRACT

A safety interlock for a door of an automatic washing machine is disclosed. The interlock securely latches the door during a spin cycle to prevent the operator of the machine from opening the door and catching his hand in the rotating motor driven drum. The interlock operates during operation of the motor and during a time delay period following de-energization of the motor to permit the drum to coast to a safe speed or to a stop. Included in the interlock is a switch member operable upon closure of the door to at least partially complete a circuit between the motor and a bimetallic element. The remainder of the circuit is completed by a timer driven switch, and when the circuit is completed the bimetallic element is heated to move a latch on the frame of the appliance into locking engagement with a latch on the door.

2 Claims, 6 Drawing Figures

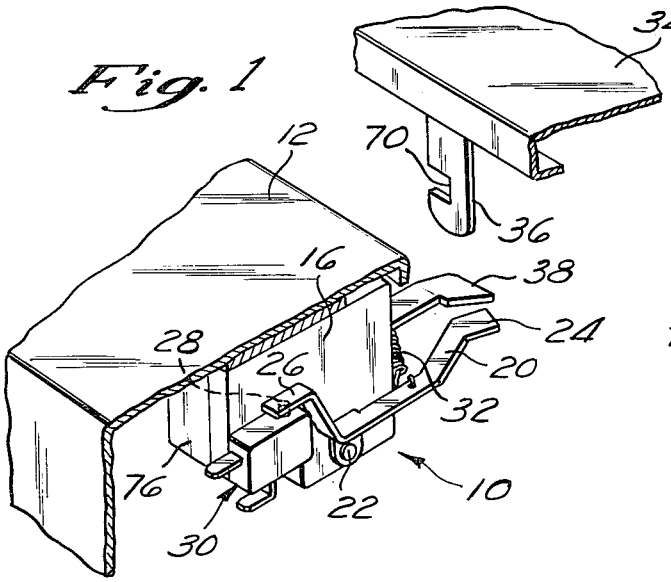
Fig. 1
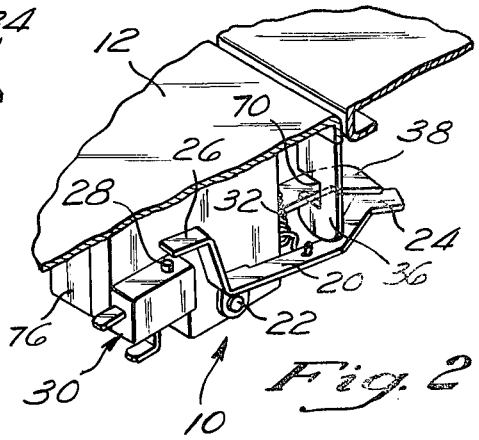
Fig. 2
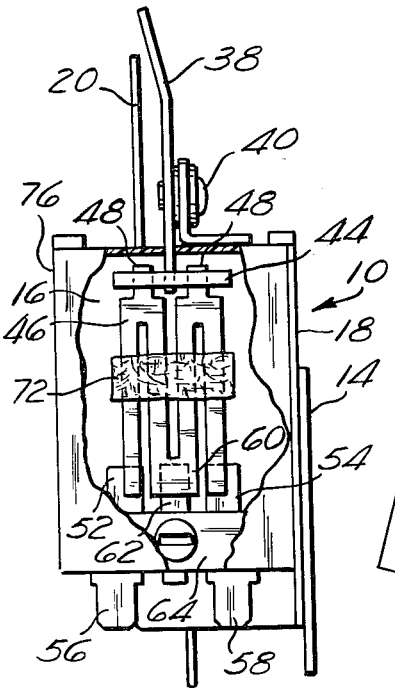
Fig. 5
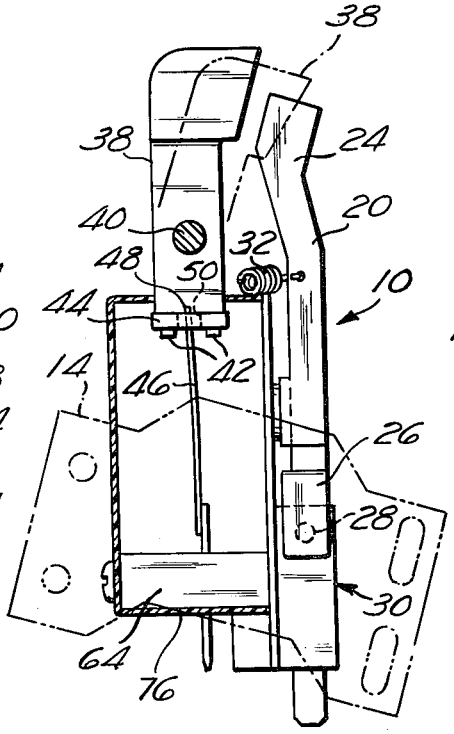
Fig. 3
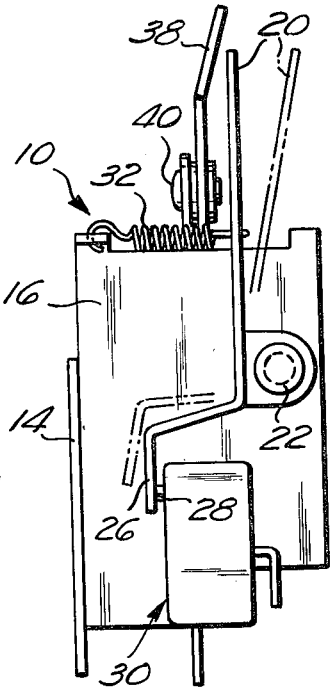
Fig. 4
Fig. 6
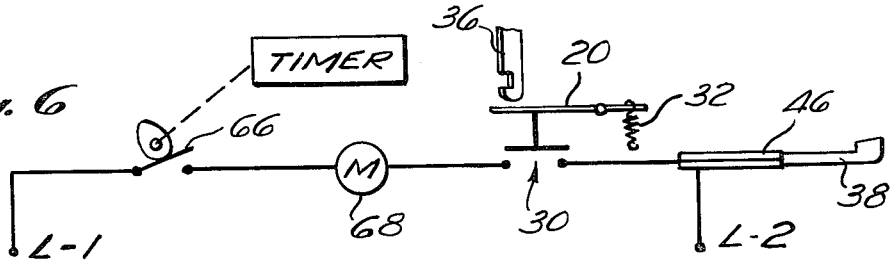

BIMETAL LID LOCK

BACKGROUND OF THE INVENTION

This invention relates to a laundry appliance having a door locking apparatus for maintaining the access door locked during the water extraction operation of the clothes-containing tub which is accomplished by spinning the tub at a relatively high speed that is thereby inherently dangerous if at this time the rotating tub is accessible.

In view of the above problem, prior art efforts have been directed to a number of interlock devices to accomplish the above-mentioned objectives. One such interlock device is shown in U.S. Pat. No. 3,272,935, wherein the patentees recognize that it is important to prevent the opening of the appliance lid during the spin cycle, and therefore provide an interlock latch mechanism which includes a switch which is operated by a striker member associated with the lid. Upon closure of the lid, the switch operates to energize a solenoid if the machine is in its spin cycle or to permit the solenoid to be energized when the spin cycle is reached. The solenoid attracts a pivoted arm which engages the striker member to securely lock the lid. Other examples of such a mechanism may be found in U.S. Pat. Nos. 3,638,457 and 3,602,015.

The use of a solenoid to operate the lid lock results in a costly and complex arrangement. More important, however, is the fact that the solenoid operates in an instantaneous manner when the circuit to the drive motor is interrupted. Therefore, it is possible to open the lid while the drum is spinning at a high speed while coasting to a stop. To overcome this problem, proposals have been made to provide a brake on the drive shaft of the machine which stops rotation upon the de-energization of the solenoid. Here again, however, the basic cost of the appliance is increased.

To overcome these problems, a proposal is set forth in U.S. Pat. No. 3,608,337, wherein the patentee proposes to hold an electrically operated door latch in a locked condition by the voltage developed by the motor during regenerative braking of the drum or cylinder at the end of the washing program. This is achieved by shunting the field and the armature of the motor, disconnecting the supply from a control thyristor, and running the motor as a generator using, initially, the residual magnetism of the field. While this arrangement accomplishes a desired result, it requires additional switching devices and does not eliminate the need for a solenoid.

SUMMARY OF THE INVENTION

This invention overcomes these prior art problems by providing a locking device wherein the movement of the circuit responsive latch member is controlled by the heating and cooling of a bimetallic element. The bimetallic element is in a circuit with a timer-controlled switch, a lid-actuated switch, and the drive motor for the drum so that closure of the lid operates the lid-operated switch to place the bimetallic element in the circuit if the timer-operated switch is closed or when the timer-operated switch is closed depending upon the condition of the appliance cycle.

The initial surge of current through the motor causes relatively rapid operation of the bimetallic element, and locking of the lid. It has been found that a 1 or 2-second response is attainable upon locking. However, there is a desirable lag on opening when the circuit is broken, since the bimetallic element is cooled rather slowly. Opening is, of course, controlled by the temperature of the water over ambient, and predetermined time delays may be obtained by suitably insulating the bimetallic element.

BRIEF DESCRIPTION OF THE DRAWING

FIG. 1 is a fragmentary, perspective view of a lid lock assembly and lid in accordance with the teachings of this invention;

FIG. 2 is a fragmentary, perspective view similar to FIG. 1, but showing the lid in a locked condition;

FIG. 3 is a top plan view partly in section, showing the latching blade in its locked (phantom outline) and unlocked (solid outline) conditions;

FIG. 4 is a side elevational view showing the switch lever in its de-energizing condition (solid outline) and its energizing position (phantom outline);

FIG. 5 is an elevational view of the other side of the latching device, with portions of a cover broken away to show the bimetallic element; and FIG. 6 is a schematic view of the circuit according to this invention.

DETAILED DESCRIPTION OF THE INVENTION

Referring now to the drawings, there is illustrated a lid locking mechanism 10 according to this invention. The mechanism 10 can be utilized for any type of closure, but is particularly adapted to latch the lid of an automatic washer or dryer during a high speed spin cycle, to prevent opening of the lid and exposure of a rapidly rotating drum. The latching assembly 10 is affixed to a housing 12 of, for example, an automatic washer by a mounting plate 14. The latching assembly 10 includes an L-shaped main support frame 16 which has a leg 18 fastened to the bracket 14. A switch lever 20 is pivotally connected to the main support frame 16 by a pivot pin 22. The switch lever 20 has a blade end 24 which projects into the tub area of the appliance and has a switch actuating arm 26 which contacts a button 28 of a snap switch 30. The snap switch 30 is open when the arm is in its normal spring-biased position in contact with the button 28 and is closed when the arm 20 is in its phantom outline position as illustrated in FIG. 4.

There is provided on the appliance a conventional hinged lid 34 and the hinged lid is provided with a hook latch member 36. The latch member 36 is positioned so that it will strike the blade portion 24 and thereby depress the switch arm 20 to cause the switch arm 20 to attain its phantom outline position as shown in FIG. 4 and release the button 28 to thereby close the switch 30.

The assembly 10 also includes a latching blade 38 which is pivotally connected to a pin 40 associated with the main support frame 16. A rearward end of the latching blade 38 includes two projections 42 which snugly project through slots (not shown) in an insulating block 44, which may be of suitable ceramic or the like.

A bimetallic element 46 is provided and has a pair of tabs 48 which project loosely through slots 50 in the insulating block 44. The bimetallic element 46 is serpentine in shape and has ends connected to terminals 52 and 54 which are associated with spade connectors 56 and 58, respectively. A central bend portion 60 of the bimetallic element 46 is supported by a tab 62 which is electrically insulated from the spade connectors 56 and 58 by an insulating block 64.

Closure of the lid 34 causes at least partial completion of a circuit, depending on whether or not a timer-actuated switch 66 is also closed. Therefore, if the timer has not reached the spin portion of the cycle, closure of the lid merely conditions the circuit for completion when the switch 66 is closed. When the entire circuit is completed, a motor 68 is energized to begin the spinning of the drum. The initial starting surge of current for the motor 68 rapidly heats the bimetallic element 46 to its operating temperature and the bimetallic element 46 flexes to move the latching blade 38 to the position illustrated in FIG. 2. The latching blade 38 enters a recessed portion 70 of the latch member 36 to prevent the lid from being raised until the timer ends the spin cycle and opens the switch 66. However, the bimetallic element does not cool immediately, and the latch remains locked for a predetermined time period of up to about two minutes. This time period, of course, is affected by the temperature within the appliance. The time period may be varied by wholly or partially sheathing the bimetallic element 46 in a heat insulating flexible sleeve 72, which may be asbestos or the like.

Therefore, since it is desirable to delay opening of the lid, the use of a bimetallic element having a quick heat-up and a slow cool-down feature results in a highly advantageous arrangement.

To protect the bimetallic element from being splashed by water, there is provided a plastic cover 76 which snaps in place on the frame 16.

While the invention has been described in connection with specific embodiments thereof, it is to be clearly understood that this is done only by way of example, and not as a limitation to the scope of the invention as set forth in the objects thereof and in the appended claims.

What is claimed is:

1. A safety interlock for a door of an appliance or the like having motor driven means therein, comprising a door movable between open and closed positions, a motor driving said driven means, a frame member, a latch mechanism mounted on said frame member, said latch mechanism including switch means having a switch arm pivotally connected to said frame member for movement along a path of travel in a first plane, said switch arm having first and second ends, a switch mounted on said frame and being in the path of travel of said switch arm, a bimetallic element having first and second ends, said bimetallic element being fixed at said first end to said frame member and carrying latch finger means at said second end, said bimetallic element, upon the application of heat thereto, being movable to move said latch finger in a second plane angularly related to said first plane, said switch closing a portion of an electrical circuit upon movement of said switch arm, said motor and bimetallic element being in said circuit, a timer control switch in said circuit operable to complete the remainder of the circuit, projection means carried by said door and engaging said switch arm upon closure of said door, said projection means having a notch therein positioned in said second plane when the door is closed and engageable by said latch finger upon application of heat to said bimetallic element when said circuit is completed.

2. A safety interlock according to claim 1, wherein said first and second planes are angularly related to 90°.

* * * * *